United States Patent [19]

Peter

[11] 4,223,495

[45] Sep. 23, 1980

[54] PRESTRESSED STEEL SUPPORT STRUCTURE AND METHOD OF ERECTING THE SAME

[76] Inventor: Emil Peter, Dammweg, Marthalen, Switzerland

[21] Appl. No.: 951,146

[22] Filed: Oct. 13, 1978

[30] Foreign Application Priority Data

Oct. 14, 1977 [CH] Switzerland ..... 12597/77

[51] Int. Cl.[2] ..... E04C 3/10

[52] U.S. Cl. ..... 52/223 R; 14/22; 52/87; 52/743

[58] Field of Search ..... 52/223 R, 743, 87; 14/18, 19, 22

[56] References Cited

U.S. PATENT DOCUMENTS

| | | | |
|---|---|---|---|
| 3,088,246 | 5/1963 | Thiman | 52/87 X |
| 3,385,015 | 5/1968 | Hadley | 52/223 R |
| 3,561,178 | 2/1971 | Finsterwalder et al. | 52/223 R |
| 4,144,686 | 3/1979 | Gold | 52/223 R |

FOREIGN PATENT DOCUMENTS

| | | | |
|---|---|---|---|
| 11335 | 2/1952 | Fed. Rep. of Germany . | |
| 901423 | 1/1954 | Fed. Rep. of Germany . | |
| 1941978 | 1/1972 | Fed. Rep. of Germany . | |
| 2156017 | 5/1973 | Fed. Rep. of Germany | 52/223 R |

*Primary Examiner*—Ernest R. Purser
*Attorney, Agent, or Firm*—O'Brien & Marks

[57] ABSTRACT

A prestressed steel support structure and method of erecting the same having bearing supports and containing at least one tension element having at least one hollow profile member extending in a catenary configuration between support locations and within which there is arranged at least one prestressing cable. The hollow profile member is provided with a filler and the prestressing cable forms a connection with the hollow profile member by means of such filler.

4 Claims, 12 Drawing Figures

PRESTRESSED STEEL SUPPORT STRUCTURE AND METHOD OF ERECTING THE SAME

BACKGROUND AND OBJECTS OF THE INVENTION

The present invention relates to a new and improved construction of prestressed steel support structure having bearing supports or support means and to a method of erecting the same.

It is a primary object of the present invention to provide a new and improved construction of support structure of the previously mentioned type and a method of erecting the same, the stability of which, notwithstanding its easier mode of construction, exceeds the stability of heretofore known devices of this type and especially allows for a price worthy erection of widely spanned support structures.

In order to implement these objects and others which will become more readily apparent as the description proceeds, the steel support structure comprises at least one tension element having at least one hollow profile or section member which extends in a cable-like configuration or catenary curve between support locations and within which there is arranged at least one prestressing or pretensioning cable. The hollow profile member is provided with a filler material or filler and the prestressing cable forms in conjunction with the filler a connection with the hollow profile member.

The method of erecting the inventive support structure contemplates drawing the prestressing or pretensioning cable into the hollow profile member and tensioning the same at least to such an extent that there is compensated the bending through or sag of the support structure due to its inherent weight. Thereafter, the hollow profile member is pressed out with the filler so that there is formed a connection between the prestressing cable and the hollow profile member.

There is preferably used as the hollow profile member a steel hollow profile or sectional element and as the filler injection cement (mortar).

BRIEF DESCRIPTION OF THE DRAWINGS

The invention will be better understood and objects other than those set forth above, will become apparent when consideration is given to the following detailed description thereof. Such discription makes reference to the annexed drawings wherein.

DETAILED DESCRIPTION OF THE PREFERRED EMBODIMENTS

Figure 1:
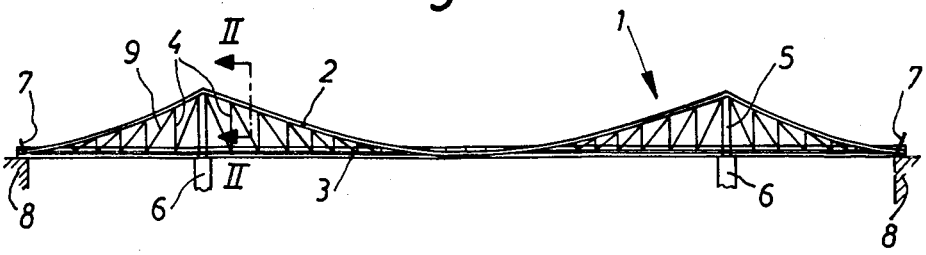
FIG. 1 is a schematic front view of a suspension bridge employing the teachings of the invention.

Describing now the drawings, with the exemplary embodiment of steel support structure shown in FIG. 1, the same constitutes a suspension bridge 1 having the bearing supports or bearing support means 8. As contemplated by the invention, tension elements 2 extend over pylons 5 which are arranged at the pillars or posts 6. These tension elements 2 are attached at the ends of the bridge roadway support 3 by means of the cable anchoring devices or cable anchorers 7. The roadway support 3 is connected by means of suspension posts or hangers 4 with the tension elements 2. Tension struts or tie bars 9 between the roadway support 3 and the tension elements 2 serve for transmitting transverse forces.

Figure 2:
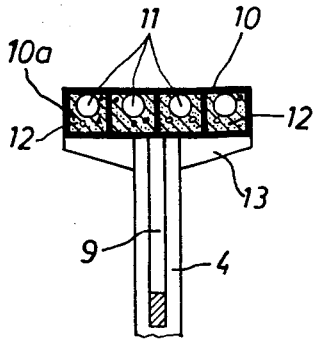
FIG. 2 is a cross-sectional view through a tension element, taken substantially along the line II—II of FIG. 1.

FIG. 2 shows a sectional view through a tension element 2 of the suspension bridge 1 and which is constructed according to the invention. It encompasses a steel hollow profile or section member 10 which is subdivided into four channels 10*a*. In each channel 10*a* there extends a conventional prestressing cable 11. These prestressing cables 11 are embedded in a suitable filler such as injection cement (mortar) 12, so that between each cable 11 and the hollow profile member 10 there is formed a sturdy connection. Mounted at the tension element 2 are the suspension posts or hangers 4 by means of the attachment elements 13. The inventive construction of the tension elements 2 enables mounting the suspension posts or hangers 4 by standard weld connections at the tension element 2. In the same manner the tension struts 9 are mounted at the tension elements 2. The transverse forces exerted by the tension struts 9 thus can be transmitted in a simple manner to the tension elements 2 and the prestressing cables 11, without requiring any complicated structure.

Additionally, the prestressing cables 11 are protected by the steel profile members 10 which are pressed out with the cement (mortar) 12. During the erection of the suspension bridge 1 the prestressing or pretensioning cables 11 which have been drawn into the hollow profile member 10 are at least stressed or tensioned to such a degree that there is compensated or taken-up the bending through of the suspension bridge due to its inherent weight. Thereafter, the hollow profile members 10 are pressed out with the injection cement (mortar) 12, so that there is formed the aforementioned connection. Due to the pretensioning or prestressing of the roadway support 3 by means of the catenary shaped tension elements 2, it is possible to appreciably reduce the transverse forces, so that the elements dependent upon the transverse forces, such as the struts and the suspension posts or hangers and their rod connections can be more easily constructed. The horizonal components of the cable anchorers 7 produce a beneficial prestressing or pretensioning at the concrete roadway support 3.

Figures 3, 4, 5, 6, 7, 8, 9:
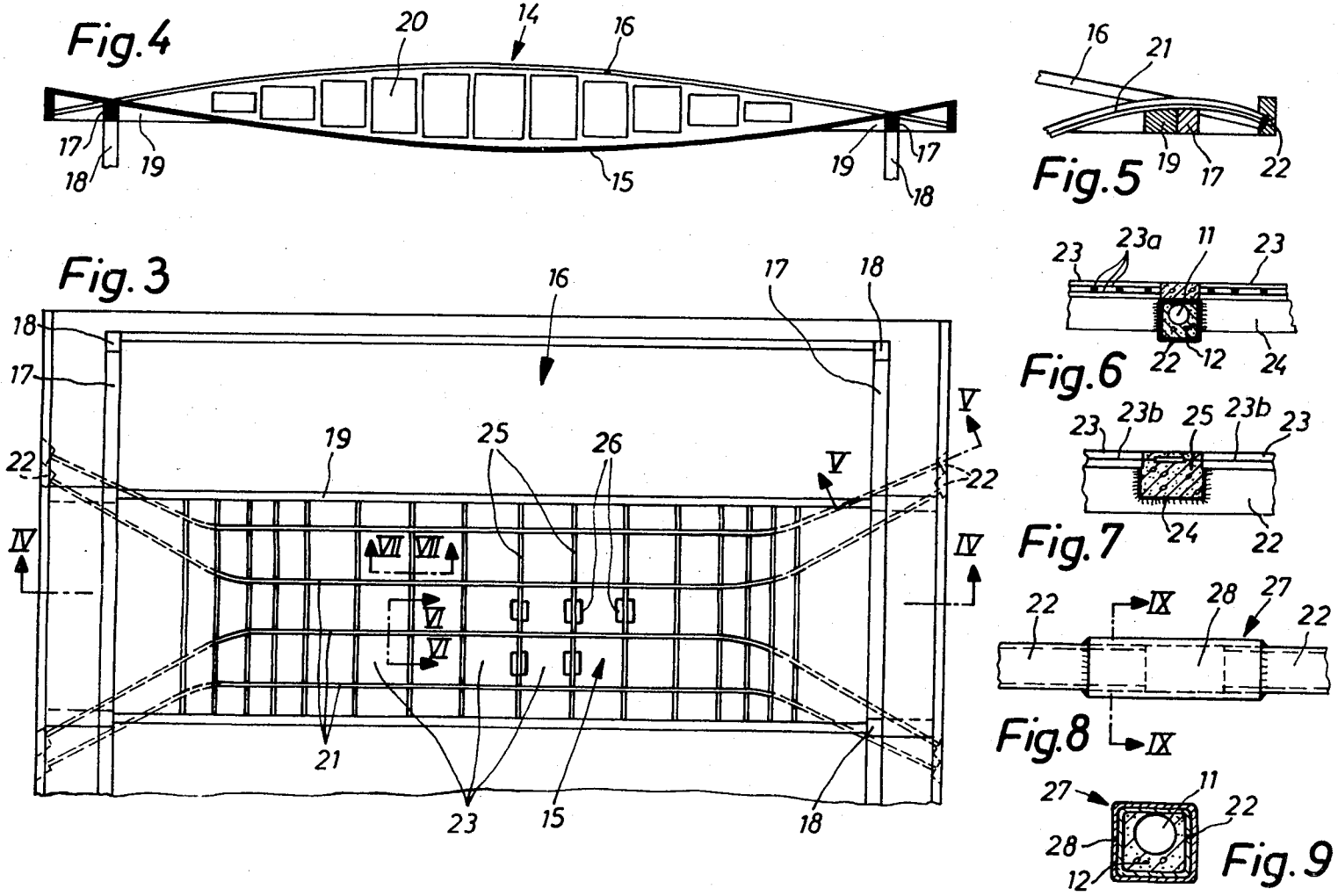
FIG. 3 is a bottom view of a domed or arched load-bearing structure utilizing the inventive apparatus.
FIG. 4 is a longitudinal sectional view through the suspension element taken substantially along the line IV—IV of FIG. 3.
FIG. 5 is a sectional view taken substantially along the line V—V of FIG. 3.
FIG. 6 is a sectional view taken substantially along the line VI—VI of FIG. 3.
FIG. 7 is a sectional view taken substantially along the line VII—VII of FIG. 3.
FIG. 8 is a fragmentary view of a displacement joint constructed according to the invention.
FIG. 9 is a sectional view taken substantially along the line IX—IX of FIG. 8.

With the exemplary embodiment of the invention as shown in FIGS. 3 to 9, there is disclosed an arched load-bearing structure 14 having suspension elements 15 and arched or domed elements 16, as for instance disclosed in Swiss Pat. No. 594,789, the disclosure of which is incorporated herein by reference. Suspension and arched elements, which are oppositely curved in a catenary shape in one direction, are supported at the supports 18 by means of the horizontal supports or carriers 17. The connection ribs 19 between the suspension and arched elements are provided with window openings 20. In the suspension element there extend tension elements 21. These tension elements 21, according to the invention, consist of hollow steel profile members 22, as shown in FIG. 6, in which there is arranged a respective prestressing or pretensioning cable 11. Between the prestressing cable 11 and the hollow profile member 22 there is formed a connection by means of the injected cement (mortar) 12. The tension elements 21 extend in catenary shape in the suspension elements 15 and are anchored at the arched or domed element 16. As apparent from the showing of FIG. 5, the tension elements 21 extend over the horizontal supports 17 into the domed element 16, where they are anchored by means of cable anchoring means or cable anchorers 22 which have only been schematically shown.

Fabricated elements 23, formed for instance of concrete, bear on the tension elements 21, these fabricated elements 23 being provided with reinforcements or reinforcement means 23*a*. The main reinforcement rods 23*b* extending in the direction of the tension elements 21, are connected with one another at the impact locations at the fabricated elements 23. As best seen by referring to FIGS. 6 and 7, the transverse joints 25 possess substantially U-shaped profile elements 24 which are secured to the hollow steel profile elements 22 of the tension elements 21. These U-shaped profile elements 24 serve as forms or form elements for casting in concrete the transverse joints after prestressing or pretensioning of the support structure. The fabricated elements 23 are provided at the underside of their ends confronting the U-shaped profile element 24 with substantially plate-shaped elements 26, as best seen by referring to FIG. 3, by means of which they can be mounted by weld connections at the U-shaped profile elements.

The erection of the support structure is accomplished in such a manner that at the floor of the hall or other area which is to be covered the prestressing cables are drawn into the hollow profile elements 22 and such are connected by means of the U-shaped profile elements 24. Thereafter, the construction is lifted and the tension elements 21 are anchored. Now the fabricated elements are laid and the primary or main reinforcement rods 23*b* are connected with one another. The cable pretensioning is accomplished by the inherent weight of the suspension element. As best seen by referring to FIG. 8, at least one hollow profile-displacement joint 27 formed in each tension element serves for compensating possible length changes of the hollow profile elements. It is formed by a sleeve 28 in which there is slidably mounted at least one of the abutting hollow profile elements 22. Finally, the hollow profile elements are pressed out with injection cement (mortar) 12 after the suspension element 15 has assumed its final shape. The displacement joint 27 is closed so as to be tension-proof.

The inventive apparatus has the advantage that for the erection of a surface support structure there are not required any auxiliary constructions, for instance for concrete forming the transverse joints between fabricated elements 23, since there can be mounted at the tension elements 21 in simple manner U-shaped profile elements which serve as the form. The surface support structure therefore can be extensively erected with prefabricated elements and without any scaffolding. The high tensile strength of the tension cables also renders possible for a large span width, a relatively light construction.

Figure 10:
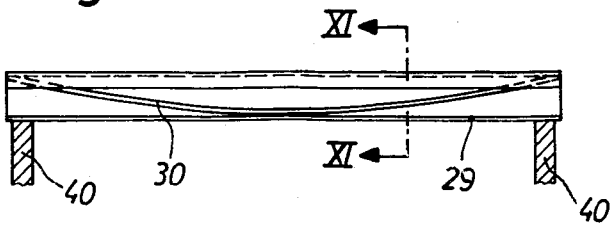
FIG. 10 is a front view of a solid wall support utilizing the inventive apparatus.
Figure 11:
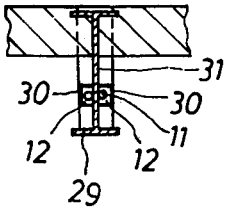
FIG. 11 is a sectional view taken along the line XI—XI of FIG. 10.

A further exemplary embodiment of the invention has been illustrated in FIGS. 10 and 11. The solid wall support 29 having double T-profile or sectional shape and mounted at the pylons 40, possesses at both sides of the web 31 a U-shaped profile element 30 mounted so as to have a catenary shape, and which forms with the web 31 a respective channel wherein there extends a prestressing or pretensioning cable 11. As contemplated by the invention, after pretensioning the cable the pretension cable and hollow profile element are pressed out with injection cement (mortar) 12.

Figure 12:
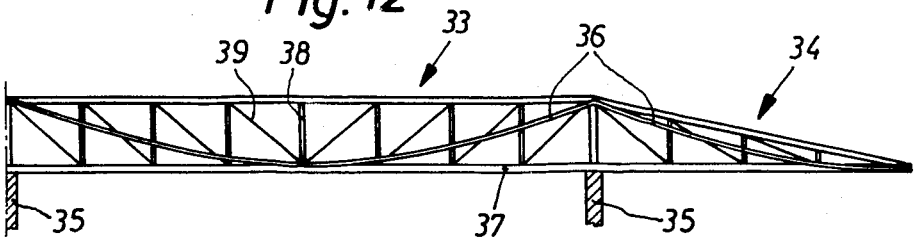
FIG. 12 is a front view of a framework support or truss employing the inventive apparatus.

Finally, in FIG. 12 there is shown a steel support structure in the form of a girder or truss support 33 having a jib or boom 34 which bears upon the pylons 35. The truss structure possesses posts 38 and struts 39. The tension elements 36 designed according to the invention extend in a catenary shape between the support or bearing locations and are mounted at chord members or a concrete plate 37. Again, here the hollow profile elements of the tension elements, following the pretensioning of the prestressing or pretensioning cable extending therein, are pressed out with injection cement (mortar) or other suitable materials.

The exemplary embodiments of the invention disclosed heretofore have the advantage that at the prestressing or tension cable there can be connected by means of the hollow profile member forming together with the cable a connection, in a most simple constructional manner, optionally directed bar forces, since, for instance, weld connections or screw connections are possible. In this respect there can be used commercially available prestressing cables. The internally located prestressing or pretensioning cable is optimumly protected by the hollow profile member surrounding the same and the filler establishing the connection.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An arched load-bearing structure comprising arched elements (16) and suspension elements (15) oppositely curved in a catenary shape and arranged adjacent one another, horizontal carriers (17) supporting said elements (16 and 15), at least one hollow profile member (22) extending in each suspension element (15), at least one prestressing cable (11) extending internally through each hollow profile member (22), said cable being secured to the hollow profile member by a filler to form a tension element (21), said tension element (21) extending in a catenary shape in the suspension elements (15) and over the horizontal carriers (17) into the arched elements (16), and said cables (11) being anchored in the arched elements (16).

2. The arched load-bearing structure as claimed in claim 1, further comprising fabricated elements (23) which bear on the tension elements (21), reinforcement rods (23*b*) for said fabricated elements extending substantially in the direction of the tension elements (21), and transverse joints (25) connecting said reinforcement rods (23*b*) to each other.

3. The arched load bearing structure as claimed in claim 2, further comprising generally U-shaped profile elements (24) extending along the transverse joints (25) of the fabricated elements (23) and secured to the hollow steel profile elements (22) of the tension elements (21), said U-shaped profile elements (24) serving as form elements for casting the transverse joints (25) in concrete.

4. A method of erecting an arched load-bearing structure, which comprises:

drawing prestressed cables into hollow profile members to form tension elements;

connecting the hollow profile members by means of U-shaped profile elements;

lifting the construction;

anchoring the prestressing cables;

laying fabricated elements which bear on the tension elements;

connecting reinforcement rods to one another at the bearing areas of the fabricated elements, and pressing out the hollow profile elements with injection cement thus securing the cables to the hollow profile members.

* * * * *